US010486781B2

(12) United States Patent
Cavazos

(10) Patent No.: US 10,486,781 B2
(45) Date of Patent: Nov. 26, 2019

(54) PADDLE BOARD SAFETY DEVICE

(71) Applicant: Michael James Cavazos, Corvallis, OR (US)

(72) Inventor: Michael James Cavazos, Corvallis, OR (US)

( * ) Notice: Subject to any disclaimer, the term of this patent is extended or adjusted under 35 U.S.C. 154(b) by 0 days.

(21) Appl. No.: 15/986,385

(22) Filed: May 22, 2018

(65) Prior Publication Data

US 2018/0334228 A1 Nov. 22, 2018

Related U.S. Application Data

(60) Provisional application No. 62/509,604, filed on May 22, 2017.

(51) Int. Cl.
*B63B 35/81* (2006.01)
*A63C 5/03* (2006.01)
*B63B 35/79* (2006.01)

(52) U.S. Cl.
CPC ..... *B63B 35/7906* (2013.01)

(58) Field of Classification Search
CPC . B63B 35/79; B63B 35/7906; B63B 35/7933; B63B 35/7946; B63B 35/85; B63B 2035/79; B63B 2035/7903; B63B 2035/7933; B63B 2035/85
USPC ..... 441/65, 74
See application file for complete search history.

(56) References Cited

U.S. PATENT DOCUMENTS 3,266,655 A 8/1966 Trunk
4,577,262 A 3/1986 Buteaux
4,955,835 A * 9/1990 Hollingsworth .... B63B 35/7933 114/174
5,127,860 A * 7/1992 Kraft ..... B63B 35/7933 441/74
D355,299 S 2/1995 Lowden
5,857,682 A * 1/1999 Hyman ..... A63C 5/03 280/14.21
D409,613 S 5/1999 McGee
6,334,537 B1 * 1/2002 Tepper ..... A45C 7/0081 206/315.1
6,386,382 B1 * 5/2002 McCausland ..... A45C 11/22 206/811
D462,171 S 9/2002 Elabour
D574,150 S 8/2008 Ross
D658,373 S 5/2012 Gros
8,672,719 B2 * 3/2014 Grimes ..... B63B 35/73 114/364
D720,927 S 1/2015 Liao
(Continued)

*Primary Examiner* — Daniel V Venne

(74) *Attorney, Agent, or Firm* — Miller Nash Graham & Dunn LLP

(57) ABSTRACT

A paddle board safety device can include a paddle board safety box having a body configured to hold at least one personal safety-related device, a lid configured to establish an open position and a closed position, a connecting portion configured to connect the lid to the body, at least one locking mechanism configured to maintain the closed position, and at least one coupling portion. The safety device can also include a paddle board safety box sleeve configured to receive the paddle board safety box, the paddle board safety box sleeve including at least one coupling portion configured to interact with the at least one coupling portion of the paddle board safety box to position and secure the paddle board safety box within the paddle board safety box sleeve.

19 Claims, 4 Drawing Sheets

(56) References Cited

U.S. PATENT DOCUMENTS

| | | | | |
|---|---|---|---|---|
| D725,388 | S | 3/2015 | Cole | |
| 9,120,218 | B1 * | 9/2015 | Stehlik | B25G 1/10 |
| 2005/0227555 | A1 * | 10/2005 | Barnes | B63B 35/79 441/74 |
| 2007/0131686 | A1 | 6/2007 | Weast | |
| 2014/0199903 | A1 * | 7/2014 | Grimes | B63B 35/73 441/74 |
| 2016/0214344 | A1 * | 7/2016 | Abrahams | A63B 21/4035 |

* cited by examiner

PADDLE BOARD SAFETY DEVICE

CROSS-REFERENCE TO RELATED APPLICATIONS

This application claims the benefit of U.S. Provisional Patent Application No. 62/509,604, filed May 22, 2017, entitled "SURVIVAL STAND UP PADDLE BOARD," the disclosure of which is incorporated herein by reference in its entirety.

TECHNICAL FIELD

This disclosure is directed to water activities and, more particularly, to stand up paddle boards.

BACKGROUND

With the advent of communication and Internet-based technologies, many people have spent increasing more time interacting with electronic gadgets as their pastime rather than participating in outdoor sports for recreation and exercise. However, if these people understood that various sports activities on land, sea, or air are beneficial not only for their health but also for their whole being, they would probably be more likely to pursue such activities. One of the latest outdoor sports activities which is now becoming popular in water sports is the use of a stand up paddle board. There are many choices now appearing in the market in terms of paddle board design, style, and safety features. However, unfortunately, it often too easy for novice and even experienced paddlers to be taken out by ocean currents or to become lost at sea. Unlike larger vessels, a conventional paddle board simply does not contain proper safety equipment for a user to call for help or to assist the user in maintaining his or her health and safety until help arrives.

Thus, there remains a need for improved safety aspects and features of stand up paddle boards.

SUMMARY

Implementations of the disclosed technology are generally directed to a stand up paddle board safety device that is configured to provide many safety features that may be of significant assistance to users, especially when navigating in open seas. A sleeve may be implemented within a paddle board to allow for a watertight dry box to be secured therein, in certain instances below a non-slip pad covering the surface of the board. A number of safety-related items may be stored within the paddle board safety box to assist the user in the event that they find themselves in an emergency situation. In certain embodiments, a sea anchor may be stored in a separate compartment and can be deployed to help keep the paddle board stable in rough water.

DETAILED DESCRIPTION

Figure 1:
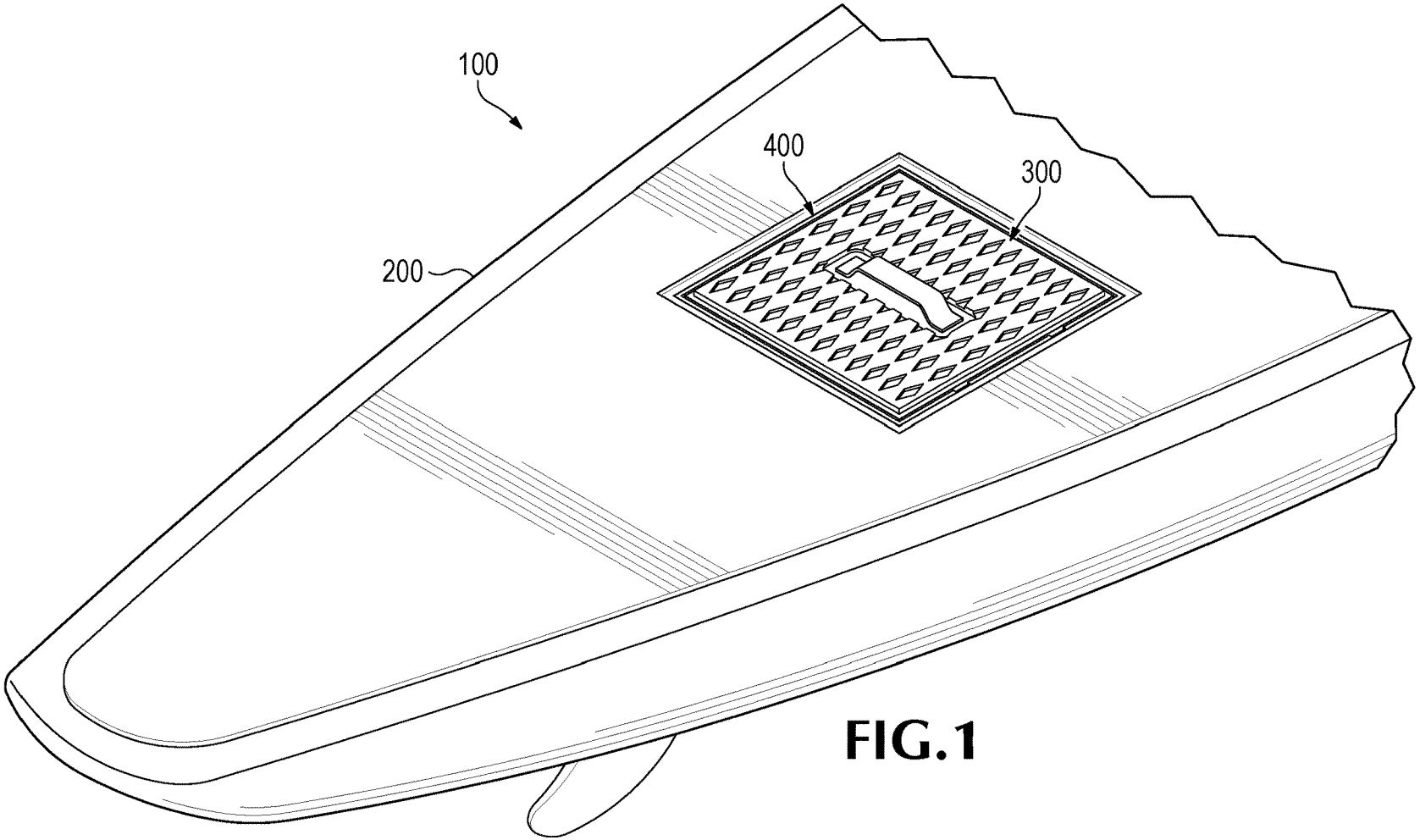
FIG. 1 illustrates a first example of a stand up paddle board safety device in accordance with certain implementations of the disclosed technology.

Implementations of the disclosed technology are generally directed to a stand up paddle board safety device including a paddle board safety box that may be configured to stow various types of survival gear. The paddle board safety box may be watertight and/or formed to be contained below the top surface of the paddle board, e.g., within a paddle board safety box sleeve that is integrated with the paddle board. The paddle board safety box may be easily removed and taken away from the paddle board as needed.

In certain embodiments, the safety box may be concealed under a non-slip pad covering the surface of the paddle board and it may also be covered by a fiberglass panel, e.g., for added protection and rigidity. The paddle board safety box may be secured by one or more coupling portions such as a clip or latch. Tracks may be cut into the sleeve or the paddle board itself, wherein the safety box may be configured to slide into the tracks and further be clicked therein such that the box may be kept securely in place.

A number of safety-related items may be stored within the dry box to assist the user in the event that they are in an emergency situation. Items that may be stored in the safety box may include, but are not limited to, the following: an Emergency Indicating Radio Beacon (EPIRB), a Personal Locator Beacon (PLB), red smoke canisters, a rocket flare, a handheld flare, a handheld marine VHF radio, a solar blanket, a whistle, a flashlight, a first-aid kit, an emergency ration with water and non-perishable food, a laminated instruction pamphlet, or shark repellent.

In certain embodiments, the paddle board may include a compartment configured to hold a sea anchor suitable for helping the user keep the paddle board stable in rough water, for example. The sea anchor may be configured to pop out of the compartment in the paddle board and lessen the drift of the paddle board when a heavy current is encountered, thus keeping the paddle board facing the current to maximize stability. This safety feature may prevent the paddle board from dragging further in a short while, as ocean currents can be strong. Such action may substantially reduce the search area.

Alternatively or in addition thereto, the paddle board may contain a bungee net for additional cargo such as a personal flotation device, D-Loops for affixing rope or straps, a leash to tether the board to the user, and a carbon fiber paddle.

Alternatively or in addition thereto, the paddle board be equipped with a micro GPS unit to enable the board to be tracked remotely for emergency rescue purposes, and also to allow the user to track their progress and their journeys for recreational purposes.

In certain embodiments, the paddle board may have a flat rocker and a recessed standing spot for improved stability and confidence development. A displacement hull improves glide and is ideal for moving in calm water. The paddle board may be designed with a dual-density EPS core which includes layers of fiberglass and high-quality epoxy, utilizing high heat and pressure, then bonded to a veneer. The paddle board may also have a single fin which improves tracking and a center handle that makes carrying of the stand up paddle board easier for the user.

FIG. 1 illustrates a first example 100 of a stand up paddle board safety device in accordance with certain implementations of the disclosed technology. In the example 100, a paddle board safety box 300 is secured by a paddle board safety box sleeve 400 which has been integrated with a stand up paddle board 200. The paddle board safety box may be designed to hold any of a number of suitable safety-related devices or components as discussed above.

Figure 2:
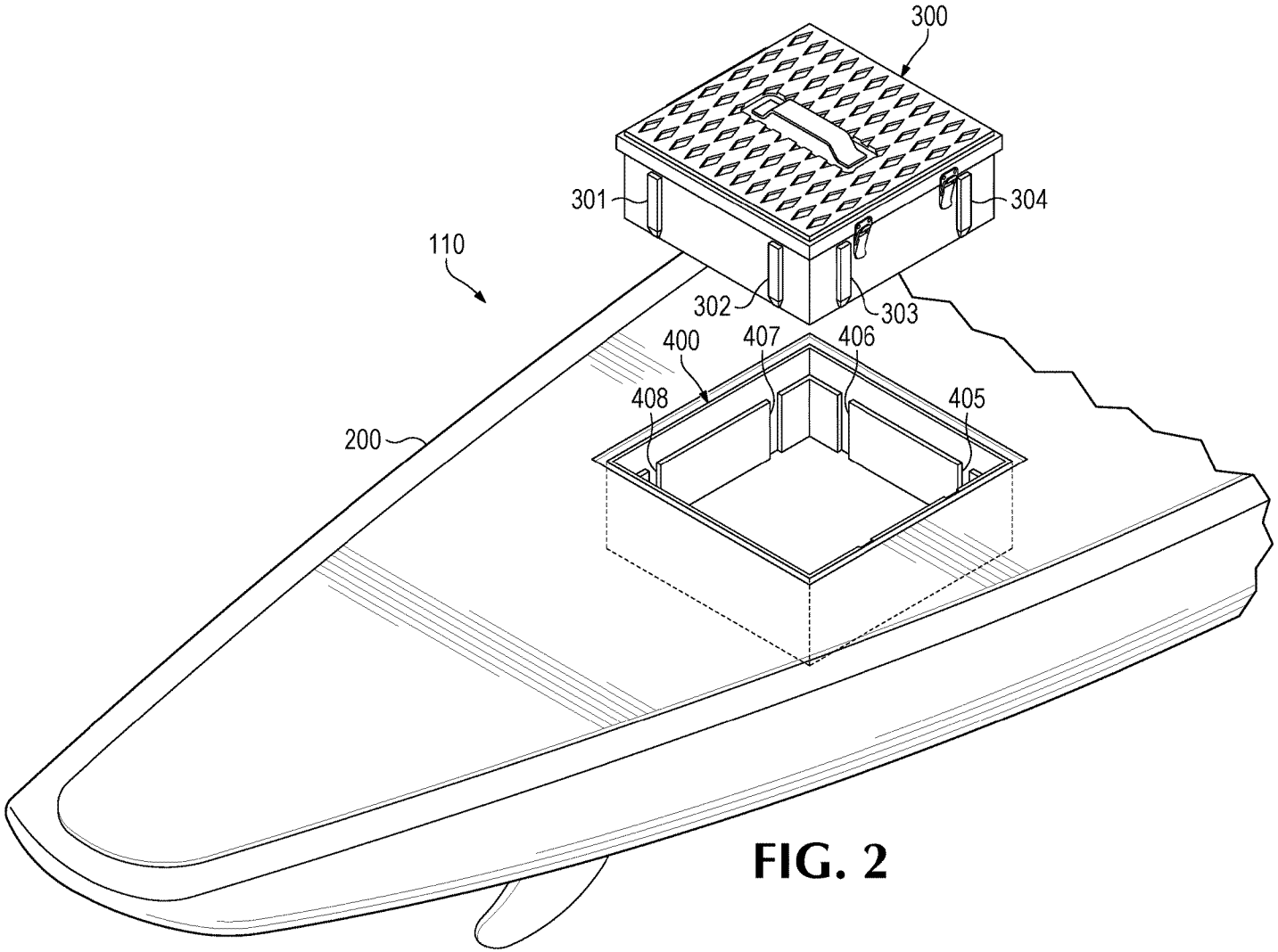
FIG. 2 illustrates a second example of the stand up paddle board safety device in accordance with certain implementations of the disclosed technology.

FIG. 2 illustrates a second example 110 of the stand up paddle board safety device in accordance with certain implementations of the disclosed technology. In the example 110, the paddle board safety box 300 has been removed from the safety box sleeve 400. The paddle board safety box 300 has coupling portions 301-308 that are configured to respectively mate with corresponding coupling portions 401-408 of the safety box sleeve 400.

In the example, the safety box coupling portions 301-308 may be extruding portions of the safety box 300 or generally rectangular (or other suitably shaped) members, e.g., plastic guide rails, that are attached to the paddle board safety box 300, and the safety box sleeve coupling portions 401-408 may be channels formed within the sleeve 400 and configured to receive the guide rails 301-308. However, it will be appreciated that any suitable number and type of coupling devices, components, or mechanisms may be implemented to enable the safety box 300 to be adequately secured within the safety box sleeve 400.

Also, in certain embodiments, one or more securing mechanisms, such as slide latches or other suitable devices or components, may be integrated with and/or within either or both of the safety box 300 and the safety box sleeve 400 to maintain a secure positioning of the safety box 300 within the safety box sleeve 400.

Figure 3:
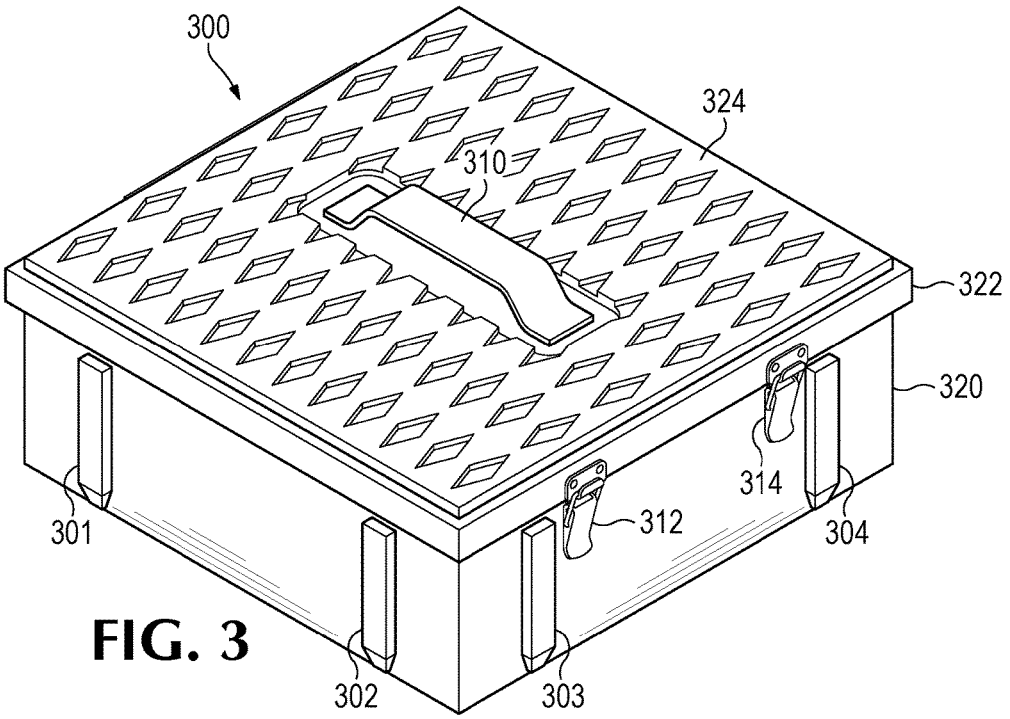
FIG. 3 illustrates a top perspective view of the stand up paddle board safety box in accordance with certain implementations of the disclosed technology.

FIG. 3 illustrates a top perspective view of the stand up paddle board safety box 300 in accordance with certain implementations of the disclosed technology. In the example, the safety box 300 includes a body 320 and a lid 322 configured to establish an open position and a closed position of the safety box 300. Either or both of the body 320 and the lid 322 may be made of aluminum or stainless steel or any other suitable material. The body 320 and/or lid 322 may be anodized or powder-coated, e.g., to prevent corrosion and/or provide enhanced aesthetics.

In the example, the safety box 300 further includes two locking mechanisms 312 and 314 that are configured to keep the safety box closed 300, e.g., while the paddle board is in use in water. The locking mechanisms 312 and 314 may be stainless steel over-center latches, for example, though it will be appreciated that any suitable number or type of locking mechanisms may be implemented.

In the example, the safety box 300 also includes a handle 310 that may be configured to allow a user to readily and easily remove, e.g., lift, the paddle board safety box 300 from within the safety box sleeve 400. The handle 310 may be made of rubber or nylon webbing, for example, or any other suitable material.

In the example, the paddle board safety box 300 also includes an external layer 324 that is situated on top of the lid 322. The external layer 324 may be a rubber deck pad or "traction pad" and the external layer may be configured to substantially match the paddle board deck, e.g., so as to provide a seamless appearance when the safety box 300 is installed. A rubber gasket or other suitable component may be integrated within or under the external layer 324 so as to establish a water-proof environment within the safety box 300 when the box 300 is locked in the closed position.

Figure 4:
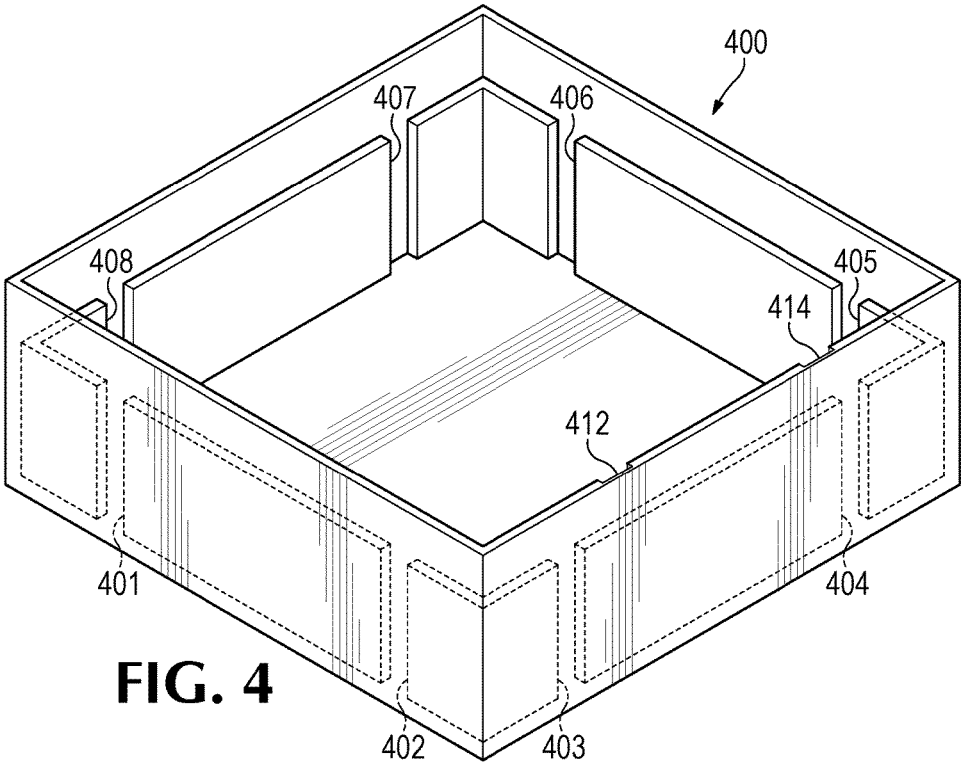
FIG. 4 illustrates a top perspective view of the stand up paddle board safety box sleeve in accordance with certain implementations of the disclosed technology.

FIG. 4 illustrates a top perspective view of the stand up paddle board safety box sleeve 400 in accordance with certain implementations of the disclosed technology. In the example, all of the coupling portions 401-408 may be seen. As noted above, the safety box sleeve coupling portions 401-408 may be channels formed within the sleeve 400, but it will be appreciated that any suitable number and type of coupling devices, components, or mechanisms may be implemented to enable the safety box 300 to be adequately secured within the safety box sleeve 400. In the example, the safety box sleeve 400 further includes two notches 412 and 414 configured to respectively provide space for the locking mechanisms 312 and 314 of the safety box 300 when the safety box 300 is positioned within the sleeve 400.

Figure 5:
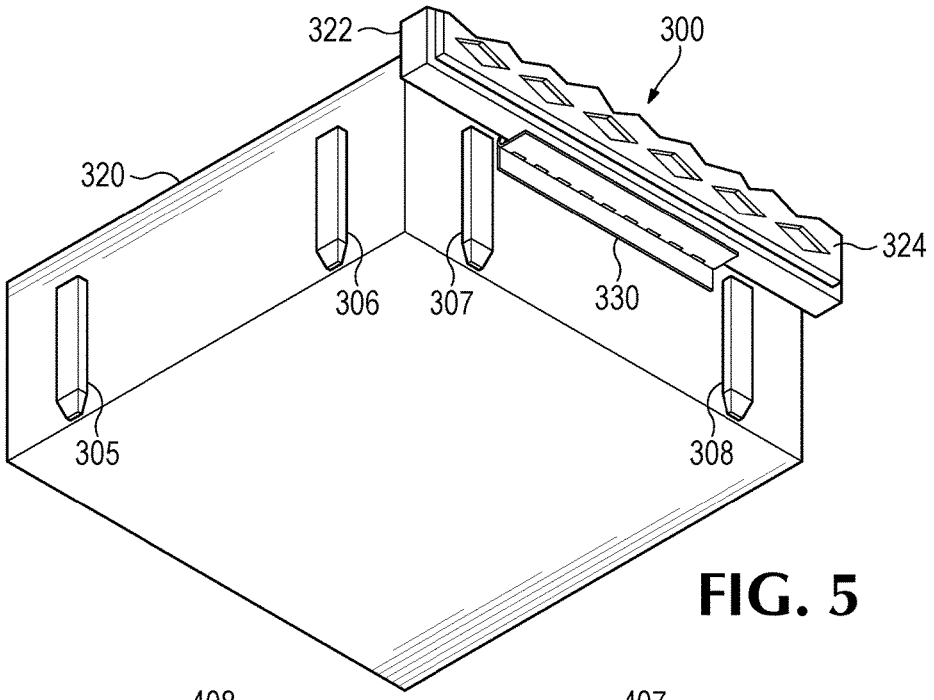
FIG. 5 illustrates a bottom perspective view of the stand up paddle board safety box in accordance with certain implementations of the disclosed technology.

FIG. 5 illustrates a bottom perspective view of the stand up paddle board safety box 300 in accordance with certain implementations of the disclosed technology. In the example, the paddle board safety box 300 includes a hinge 330, though it will be appreciated that any suitable connecting portion may be implemented to connect the lid 322 to the body 320 of the safety box 300.

Figure 6:
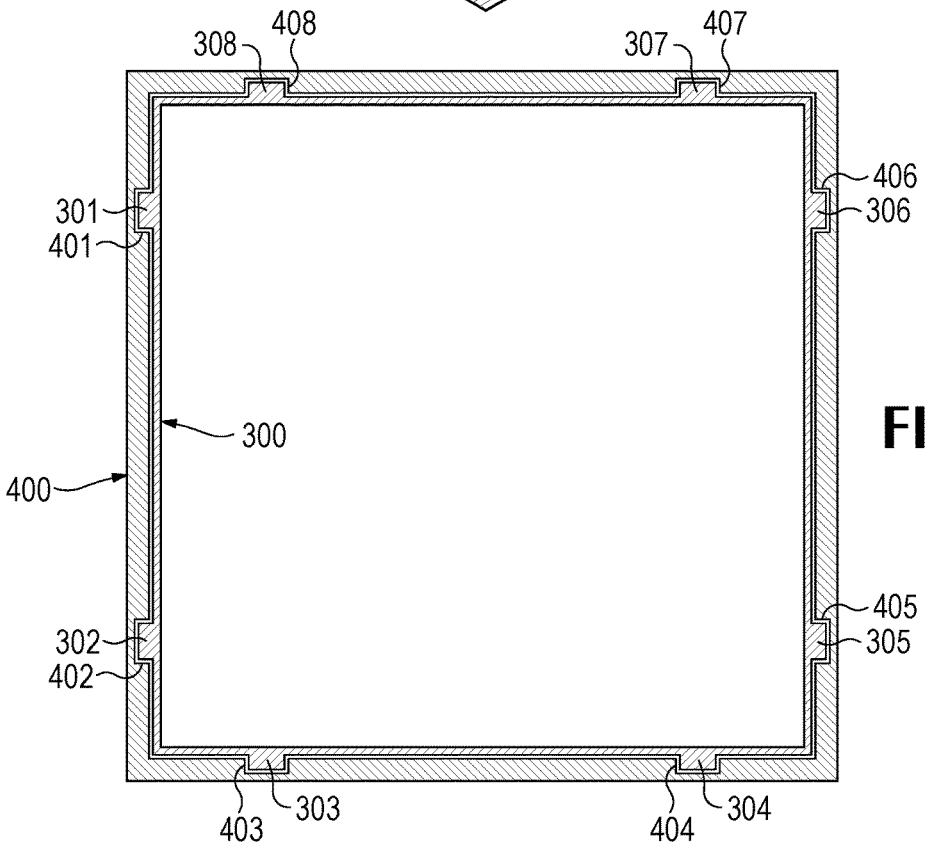
FIG. 6 illustrates a cross-sectional top view of the stand up paddle board safety box installed within the safety box sleeve in accordance with certain implementations of the disclosed technology.

FIG. 6 illustrates a cross-sectional top view of the stand up paddle board safety box 300 installed within the safety box sleeve 400 in accordance with certain implementations of the disclosed technology. In the example, the safety box coupling portions 301-308 are respectively mated with the safety box sleeve coupling portions 401-408.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this disclosure to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "right" and "left" are used for convenience and in reference to the diagrams provided in figures. But the disclosed subject matter may have a number of orientations in actual use or in different implementations. Thus, a feature that is vertical, horizontal, to the right, or to the left in the figures may not have that same orientation or direction in all implementations.

Although specific embodiments of the invention have been illustrated and described for purposes of illustration, it will be understood that various modifications may be made without departing from the spirit and scope of the invention. Accordingly, the invention should not be limited except as by the appended claims.

The invention claimed is:

1. A stand up paddle board safety device, comprising:

a paddle board safety box, the paddle board safety box including:

a body configured to hold at least one personal safety-related device;

a lid configured to establish an open position and a closed position;

a connecting portion configured to connect the lid to the body;

at least one locking mechanism configured to maintain the closed position, wherein the at least one locking mechanism includes an over-center latch; and at least one coupling portion; and a paddle board safety box sleeve configured to receive the paddle board safety box, the paddle board safety box sleeve including at least one coupling portion configured to interact with the at least one coupling portion of the paddle board safety box to position and secure the paddle board safety box within the paddle board safety box sleeve.

2. The stand up paddle board safety device of claim 1, wherein either or both of the body and the lid are made of aluminum or stainless steel.

3. The stand up paddle board safety device of claim 1, wherein either or both of the body and the lid are anodized or powder-coated.

4. The stand up paddle board safety device of claim 1, the paddle board safety box further comprising a handle.

5. The stand up paddle board safety device of claim 4, wherein the handle is made of rubber.

6. The stand up paddle board safety device of claim 1, wherein the connecting portion is a hinge.

7. The stand up paddle board safety device of claim 1, the paddle board safety box further comprising an external layer situated on top of the lid.

8. The stand up paddle board safety device of claim 1, wherein the paddle board safety box sleeve is a formed portion of a stand up paddle board.

9. The stand up paddle board safety device of claim 1, wherein the at least coupling portion of the paddle board safety box is a guide rail.

10. The stand up paddle board safety device of claim 9, wherein the at least one coupling portion of the paddle board safety box sleeve is a channel configured to receive the guide rail.

11. A stand up paddle board safety device, comprising:

a paddle board safety box, the paddle board safety box including:

a body configured to hold at least one personal safety-related device;

a lid configured to establish an open position and a closed position;

a connecting portion configured to connect the lid to the body;

at least one locking mechanism configured to maintain the closed position; and at least one coupling portion, wherein the at least coupling portion of the paddle board safety box is a guide rail; and a paddle board safety box sleeve configured to receive the paddle board safety box, the paddle board safety box sleeve including at least one coupling portion configured to interact with the at least one coupling portion of the paddle board safety box to position and secure the paddle board safety box within the paddle board safety box sleeve.

12. The stand up paddle board safety device of claim 11, wherein the at least one coupling portion of the paddle board safety box sleeve is a channel configured to receive the guide rail.

13. The stand up paddle board safety device of claim 11, wherein either or both of the body and the lid are made of aluminum or stainless steel.

14. The stand up paddle board safety device of claim 11, wherein either or both of the body and the lid are anodized or powder-coated.

15. The stand up paddle board safety device of claim 11, the paddle board safety box further comprising a handle.

16. The stand up paddle board safety device of claim 15, wherein the handle is made of rubber.

17. The stand up paddle board safety device of claim 11, wherein the connecting portion is a hinge.

18. The stand up paddle board safety device of claim 11, the paddle board safety box further comprising an external layer situated on top of the lid.

19. The stand up paddle board safety device of claim 11, wherein the paddle board safety box sleeve is a formed portion of a stand up paddle board.

* * * * *